US005303628A

United States Patent [19]

Salazar

[11] Patent Number: 5,303,628

[45] Date of Patent: Apr. 19, 1994

[54] MOUTHPIECE FOR A CLARINET AND A SAXOPHONE

[76] Inventor: Jorge R. Salazar, 115-17 123rd St., South Ozone Park, N.Y. 11420

[21] Appl. No.: 41,779

[22] Filed: Apr. 2, 1993

[51] Int. Cl.[5] ..... G10D 9/02

[52] U.S. Cl. ..... 84/383 R

[58] Field of Search ..... 84/383 R, 398

[56] References Cited

U.S. PATENT DOCUMENTS 5,105,701 4/1992 Hall et al. ..... 84/383 R

*Primary Examiner*—Michael L. Gellner
*Assistant Examiner*—Patrick J. Stanzione
*Attorney, Agent, or Firm*—Collard & Roe

[57] ABSTRACT

The invention relates to a mouthpiece for a clarinet and saxophone to be used with a reed. The mouthpiece has a tip and a face having two spaced sides extending towards each other from the tip. The face has an opening adjacent to the tip between the sides and a longitudinal bore communicating with the opening. The face is arcuately curved downwardly toward the tip thereby forming a face gap distance between the face and the reed. A wing member extends from each of the sides away from the opening so that the mouthpiece flares outwardly at the face to direct air into the opening. The wing members extend substantially to the tip of the mouthpiece. In addition, a spiral profile may be formed on a cylindrical surface defining the longitudinal bore. The wing members fill triangular spaced gaps between the lips to direct air into the mouthpiece opening. The mouthpiece improves the tonal qualities of the instrument and requires less effort than with conventional mouthpieces.

17 Claims, 2 Drawing Sheets

MOUTHPIECE FOR A CLARINET AND A SAXOPHONE

BACKGROUND OF THE INVENTION

1. Field of the Invention

The present invention relates to a mouthpiece for a clarinet and a saxophone. More particularly, it relates to mouthpieces having a specific facing configuration adjacent the tip of the mouthpiece to direct air into the mouthpiece opening. In addition, the invention relates to spiral profiling within the mouthpiece that channels sound waves into the instrument.

2. The Prior Art

The clarinet, which was originated in the early 1700s, has continued to grow in popularity. As a member of the woodwind family of instruments, the clarinet includes a mouthpiece having a sound baffle opening and a bore. The mouthpiece is removably mounted to the tube or body of the clarinet so that the mouthpiece may be replaced as is necessary. A single flat cane reed is clamped over the sound baffle opening and vibrates to create sound when a player blows on the tip of the mouthpiece.

Since their origination, there have been numerous modifications made, not only to the body of the clarinet, but also to the mouthpieces. Changing the physical characteristics of the clarinet body or mouthpiece results in a change in the tonal quality and playing techniques associated with each instrument. One such attempt at changing the physical characteristics of the mouthpiece is disclosed in U.S. Pat. No. 5,105,701 to Hall et al. The mouthpiece of Hall has a modified gap between the reed and the facing, and includes a tapered A-frame bridge adjacent the sound baffle of the mouthpiece.

However, mouthpiece designs have not addressed the problem of air blow-by associated with standard mouthpiece configurations. Air blow-by results from the difference in the shape of the mouthpiece and the shape to which a musician's lips can comfortably conform. Since the mouthpiece is generally cylindrical, the space on either side of the mouthpiece between both lips forms a triangular space through which air escapes. It would be advantageous to provide a mouthpiece design which more closely matches the shape of the player's lips. In addition, it would be advantageous to alter the internal configuration of the mouthpiece in order to improve the tonal quality of the instrument.

SUMMARY OF THE INVENTION

It is therefore an object of the present invention to provide a mouthpiece for a clarinet and saxophone which provides improved tonal quality.

It is a further object of the present invention to provide a mouthpiece which requires less effort to play the instrument.

It is yet another object of the present invention to provide a mouthpiece which is configured to comfortably fit between a player's lips.

It is still another object of the present invention to provide a mouthpiece which directs otherwise wasted air into the instrument.

It is a further object of the present invention to provide a mouthpiece with profiling along the longitudinal bore of the mouthpiece to improve the tonal quality of the instrument.

These and other related objects are achieved according to the invention by a mouthpiece for a clarinet and saxophone having a reed and including a tip. The mouthpiece includes a face having two spaced sides extending towards each other from the tip. The face has an opening adjacent the tip between the sides and a longitudinal bore communicating with the opening. The face is arcuately curved downwardly toward the tip, thereby forming a face gap distance between the face and a reed that may be selectively mounted to the mouthpiece in overlying relationship to the opening. A wing member extends from each of the sides away from the opening so that the mouthpiece flares outwardly at the face to direct air into the opening. The wing members extend substantially to the tip.

The wing members include a wing gap distance to the reed that is greater than the face gap distance so that the wing members provide clearance for the reed vibrations. Each of the wing members has a substantially semicircular shaped surface with an arcuate edge and a linear edge. The linear edges face each other across the sides and the opening. The arcuate edges have a wing radius of curvature equal to a tip radius of curvature. The sides have a length measured longitudinally along the face and the wing members have a length that is shorter than the side length. The arcuate edges together with the tip define a substantially circular periphery.

The mouthpiece further includes a bite surface that extends outwardly from the tip opposite the face. Each of the wing members includes an upper surface, at least a portion of said upper surface coinciding with the bite surface. The mouthpiece further includes a spiral profile formed on a cylindrical surface defining the longitudinal bore.

In an alternate embodiment of a mouthpiece for a saxophone, the saxophone has a reed and a tip. The mouthpiece further includes a face extending inwardly from the tip. The face has an opening adjacent of the tip and a longitudinal bore communicating with the opening. The face is arcuately curved downwardly towards the tip, thereby forming a gap distance between the face and a reed that may be selectively mounted to the mouthpiece in overlying relationship to the opening. The mouthpiece further includes a spiral profile formed on a cylindrical surface defining the longitudinal bore. The spiral profile winds down and away from the tip so that sound waves emanating from vibrations of the reed are channeled through the bore into the saxophone.

The spiral profile has a first end located on a cylindrical surface defining the longitudinal bore. The first end is located generally opposite the end of the opening disposed opposite the tip. The spiral profile comprises a bead with a rectangular cross section. The bead has a height of 1 mm measured perpendicular to the cylindrical surface and a width of 2 mm measured parallel to the longitudinal axis of the bore. The bead has a slope whereby adjacent points of the bead along the longitudinal axis of the bore are 1 cm apart. The bead extends approximately 25 mm from the first end along the longitudinal bore, for an alto saxophone mouthpiece. The bead extends approximately 35 mm from the first end along the longitudinal bore, for tenor saxophone mouthpiece.

A further embodiment of a mouthpiece for a clarinet and saxophone has a reed and a tip. The mouthpiece includes a face having spaced opposite sides extending towards each other from the tip. The face has an opening adjacent the tip between the sides and a longitudinal bore communicating with the opening. The face is arcuately curved downwardly towards the tip thereby forming a face gap distance between the face and a reed mounted on the mouthpiece in an overlying relationship to the opening. A pair of wing members, each extend from a corresponding one of the sides and away from the opening in a manner whereby the mouthpiece flares outwardly at the face to direct air into the opening. Each of the wing members extends substantially to the tip and has a substantially semicircular shaped surface with an arcuate edge and a linear edge. The linear edges face each other across the sides and the opening. A bite surface extends outwardly from the tip opposite the face. Each of the wing members includes an upper surface at least part of which coincides with the bite surface. A spiral band is formed on a cylindrical surface defining the longitudinal bore, so that sound waves emanating from vibrations of the reed are channeled through the bore.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF pREFERRED EMBODIMENTS

Figure 1:
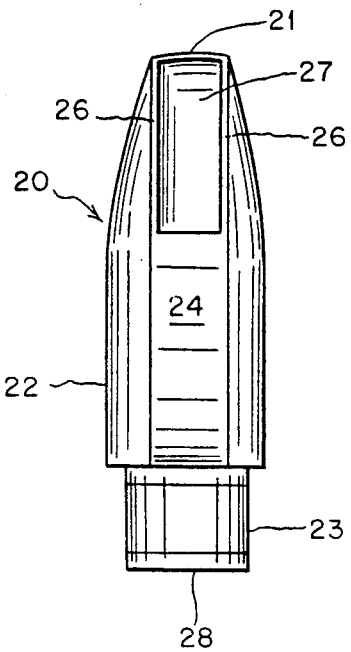
FIG. 1 (PRIOR ART)
FIG. 1 is a front side elevational view of a clarinet mouthpiece according to the prior art.

Referring now to the drawings and in particular FIG. 1, there is shown a clarinet mouthpiece 20 according to the prior art having a tip 21, a body 22 and a neck 23. A flat face 24 extends downwardly from the tip 21 along the entire length of body 22. A reed, which is not shown for the sake of clarity, may be mounted along face 24 by a ligature or clamp, also not shown. Adjacent tip 21, face 24 forms sides 26 which border an opening 27. A longitudinal bore 28 extends through neck 23 and through body 22 to communicate with opening 27.

Figure 2:
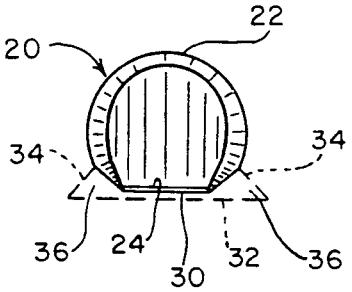
FIG. 2 (PRIOR ART)
FIG. 2 is a top plan view of a clarinet mouthpiece according to the prior art.

Referring now to FIG. 2, mouthpiece 20 is shown with a reed 30 mounted against face 24. Reed 30 provides a relatively flat surface against which lower lip 32, shown schematically in phantom line, can rest. However, upper lip 34, shown schematically in phantom line, which extends around body 22 forms substantially triangular spaces 36 adjacent to reed 30. Thus, as the musician attempts to force air between reed 30 and face 24, some of that air escapes through space 36. This problem is particularly acute with beginners and children who have not developed advanced playing techniques. In addition, experienced or professional musicians will also be affected by loss of air through space 36. In order to reduce the loss of air, there is a tendency to squeeze lips 32 and 34 together tightly. This, however, results in tiring the lip and face muscles.

Figure 3:
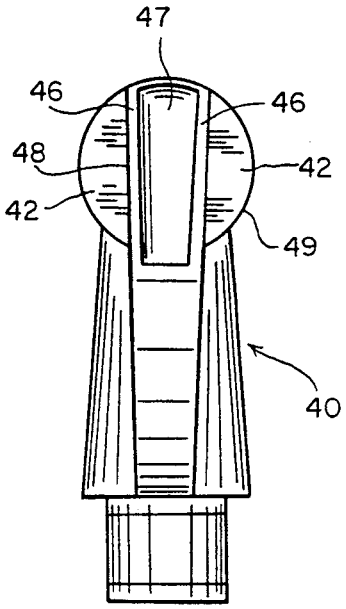
FIG. 3 is a front side elevational view of an embodiment of a clarinet mouthpiece according to the invention.
Figure 4:
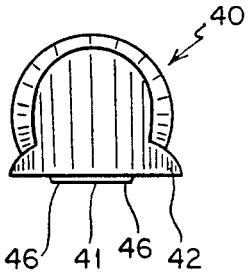
FIG. 4 is a top plan view of an embodiment of a clarinet mouthpiece according to the invention.

Referring now to FIGS. 3 and 4, there is shown mouthpiece 40 according to the invention having a wing member 42 that extends from each of the sides 46. Wing members 42 include a linear edge 48 and an arcuate edge 49. Linear edges 48 face each other across sides 46 and opening 47. FIG. 4 shows that wing members 42 are at a slightly lower elevation than tip 41 or sides 46. In this manner, reed 30, when placed against sides 46, will not have its movement impaired or constrained by the presence of wing member 42. Wing members 42 are configured and designed to completely occupy space 36, as shown in FIG. 2.

Figure 5:
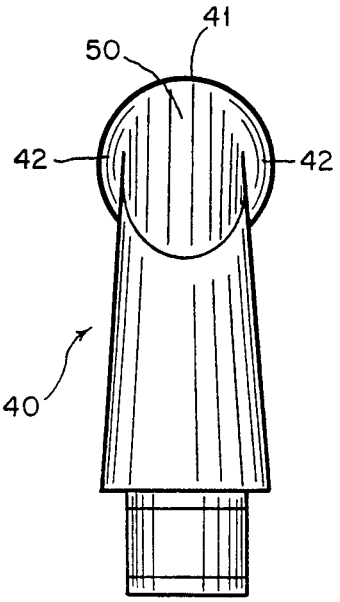
FIG. 5 is a back side elevational view of the mouthpiece.
Figure 6:
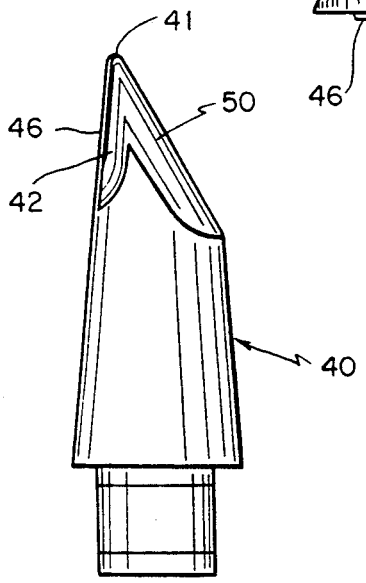
FIG. 6 is a right side elevational view of the mouthpiece.
Figure 7:
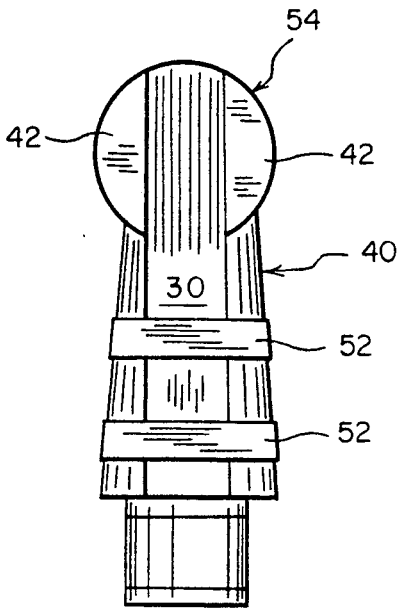
FIG. 7 is a front side elevational view of the mouthpiece showing a reed mounted thereon.

Referring now to FIGS. 5 and 6, bite surface 50 is shown extending downwardly from tip 41 along the backside of mouthpiece 40. In the vicinity of tip 41 the back surfaces of wing members 42 coincide with bite surface 50. As can be seen in FIG. 6, wing members 42 are disposed at a slightly lower elevation than sides 46 so as not to interfere with the vibration of reed 30 when placed against sides 46. As can be seen in FIG. 7, reed 30 is coupled to mouthpiece 40 by a clamp or ligature 52. Wing members 42 flare outwardly on either side of reed 30 to direct air underneath reed 30 into the instrument. Wing members 42 form a substantially circular periphery having a diameter 54 which is 3 cm, for example.

Figure 8:
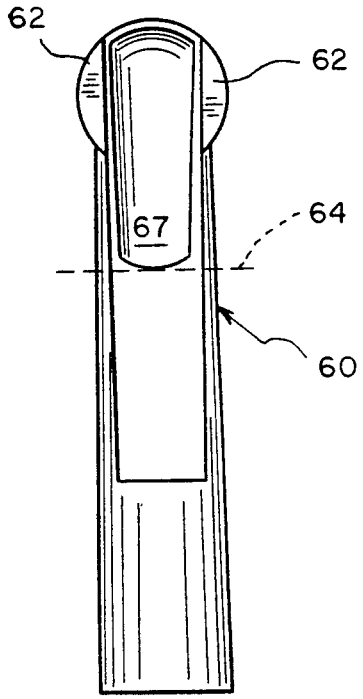
FIG. 8 is a front side elevational view of an embodiment of a tenor saxophone mouthpiece according to the invention.
Figure 9:
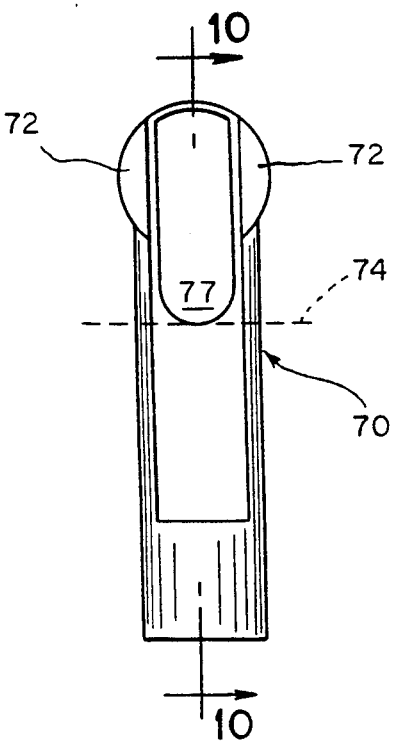
FIG. 9 is a front side elevational view of an embodiment of an alto saxophone mouthpiece according to the invention.
Figure 10:
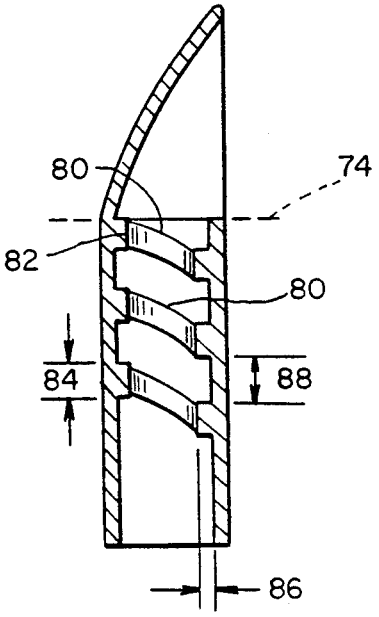
FIG. 10 is a cross-sectional view of the alto saxophone mouthpiece taken along the line 10—10 from FIG. 9.

FIG. 8 shows a mouthpiece 60 for a tenor saxophone with wing members 62. The diameter of wing members 62 is approximately 3 cm, for example. FIG. 9 shows a mouthpiece 70 for an alto saxophone with wing members 72. The diameter of wing members 72 is approximately 3 cm, for example. Mouthpieces 60 and 70 have a line 64 and 74 respectively, which demarcates the lower edges of openings 67 and 77. FIG. 10 shows a spiral profile 80 having a first end 82 which is disposed at or below lines 64 and 74. Spiral profile 80 winds downwardly away from first end 82 in a clockwise or counterclockwise direction. Spiral profile 80 terminates a linear distance of 25 mm from line 74 or a linear distance of 35 mm from line 64, for example. Spiral profile 80 has a height 84 of 2 mm and a width 86 of 1 mm, for example. A linear distance 88 between adjacent points on spiral profile 80 is 1 cm, for example.

Spiral profile 80 can be formed by adding a band or bead to the cylindrical surface defining the longitudinal bore. A band is a thin, flat strip and a bead is a small molding having a continuous surface. In a preferred embodiment profiling 80 has a rectangular cross-section, although a circular, oval or other cross-section may be employed. In addition, profiling 80 may be achieved by cutting a channel or groove into the cylindrical surface. The cross-section of the channel or groove may be of rectangular, circular, oval or any other configuration.

It should be understood that the dimensions of wing members 42, 62 and 72 can be varied from the semicircular configurations as illustrated. Wing members 42, 62 and 72 may be of any configuration which allows the player's lips to seal comfortably and tightly around the mouthpiece to avoid air blow by. The configuration of wing members 42, 62 and 72 as illustrated, has proven to substantially conform to the shapes of the lips whereby the mouth and throat muscles are relaxed. This is due to the fact that the lips do not have to be tightly pursed in order to fill triangular spaces 36, as shown in FIG. 2.

The configuration of wing members 42, 62 and 72 results in a reduction or elimination of air blow by thereby increasing the volume of air passing through the instrument. This results in a cleaner and crisper tone from the instrument. In addition, the player can achieve a relatively higher volume level, with the mouthpiece according to the invention, than could be achieved with a conventional mouthpiece utilizing the same degree of effort. This results in less fatigue during extended playing. The benefits are particularly advantageous for beginners and children players who have not developed the muscles and lung capacity of more experienced players. In addition, since the wings extend laterally and rest against the lips, the mouthpiece is stabilized and resists side-to-side movement that occurs with conventional mouthpieces. Spiral profiling 80, additionally improves the sound quality of the instrument by channeling sound waves emanating from vibrations of the reed into the instrument, i.e., a saxophone.

While several embodiments of the present invention have been shown and described, it is to be understood that many changes and modifications may be made thereunto without departing from the spirit and scope of the invention as defined in the appended claims.

What is claimed is:

1. A mouthpiece for a musical wind instrument having a reed, said mouthpiece comprising:

a tip;

a face having two spaced sides extending toward each other from said tip, said face having an opening adjacent said tip between said sides and a longitudinal bore communicating with the opening, said face being arcuately curved downwardly toward said tip, thereby forming a face gap distance between said face and a reed that may be selectively mounted to the mouthpiece in overlying relationship to the opening; and a wing member extending from each of said sides away from the opening, so that the mouthpiece flares outwardly at said face to direct air into the opening.

2. The mouthpiece according to claim 1, wherein said wing members extend substantially to said tip.

3. The mouthpiece according to claim 2, wherein said wing members include a wing gap distance to the reed that is greater than said face gap distance, so that said wing members provide clearance for the reed vibrations.

4. The mouthpiece according to claim 3, wherein each of said wing members has a substantially semicircular shaped surface with an arcuate edge and a linear edge, said linear edges facing each other across said sides and the opening.

5. The mouthpiece according to claim 4, wherein the arcuate edges have a wing radius of curvature equal to a tip radius of curvature.

6. The mouthpiece according to claim 5, wherein said sides have a length longitudinally along said face and said wing members have a length shorter than said side length.

7. The mouthpiece according to claim 6, wherein the arcuate edges together with said tip define a substantially circular periphery.

8. The mouthpiece according to claim 7, further comprising a bite surface that extends outwardly from said tip opposite said face and wherein each of said wing members includes an upper surface, at least a portion of said upper surface coinciding with said bite surface.

9. The mouthpiece according to claim 8, further comprising:

a spiral profile formed on a cylindrical surface defining the longitudinal bore.

10. A mouthpiece for a saxophone having a reed comprising:

a tip;

a face extending inwardly from said tip, said face having an opening adjacent of said tip and a longitudinal bore communicating with the opening, said face being arcuately curved downwardly toward said tip, thereby forming a gap distance between said face and a reed that may be selectively mounted to the mouthpiece in overlying relationship to the opening; and a spiral profile formed on a cylindrical surface defining the longitudinal bore, said spiral profile winding away from said tip so that sound waves emanating from vibrations of the reed are channeled through the bore into the saxophone.

11. The mouthpiece according to claim 10, wherein said spiral profile has a first end located on a cylindrical surface defining the longitudinal bore, said first end located generally opposite the edge of the opening disposed opposite said tip.

12. The mouthpiece according to claim 11, wherein said spiral profile comprises a bead with a rectangular cross section.

13. The mouthpiece according to claim 12, wherein said bead has a height of 1 mm measured perpendicular to said cylindrical surface and a width of 2 mm measured parallel to the longitudinal axis of the bore.

14. The mouthpiece according to claim 13, wherein said bead has a slope whereby adjacent points of said bead along the longitudinal axis of the bore are 1 cm apart.

15. The mouthpiece according to claim 14, wherein said bead extends approximately 25 mm from said first end, along the longitudinal bore, for an alto saxophone mouthpiece.

16. The mouthpiece according to claim 14, wherein said bead extends approximately 35 mm from said first end, along the longitudinal bore, for a tenor saxophone mouthpiece.

17. A mouthpiece for a clarinet and saxophone having a reed, said mouthpiece comprising:

a tip;

a face having spaced opposite sides extending toward each other from said tip, said face having an opening adjacent said tip between said sides and a longitudinal bore communicating with said opening, said face being arcuately curved downwardly toward said tip, thereby forming a face gap distance between said face and a reed mounted on said mouthpiece in overlying relationship to said opening;

a pair of wing members each extending from a corresponding one of said sides and away from said opening in a manner whereby said mouthpiece flares outwardly at said face to direct air into said opening, each of said wing members extending substantially to said tip and having a substantially semicircular shaped surface with an arcuate edge and a linear edge, said linear edges facing each other across said sides and said opening;

a bite surface extending outwardly from said tip opposite said face, each of said wing members including an upper surface at least part of which coincides with said bite surface; and a spiral band formed on a cylindrical surface defining the longitudinal bore, so that sound waves emanating from vibrations of said reed are channeled through said bore.

* * * * *